US006134409A

United States Patent [19]

Staples et al.

[11] Patent Number: 6,134,409

[45] Date of Patent: Oct. 17, 2000

[54] METHOD OF AND MEANS FOR SELF-FIXED PRINTING FROM FERRO-ELECTRIC RECORDING MEMBER

[75] Inventors: Phillip Eric Staples, Warradale; Luis Lima-Marques, Stirling, both of Australia

[73] Assignee: MAN Roland Druckmaschinen AG, Offenbach am Main, Germany

[21] Appl. No.: 09/138,117

[22] Filed: Aug. 21, 1998

[30] Foreign Application Priority Data

Aug. 22, 1997 [AU] Australia ..... PO8751

[51] Int. Cl.[7] ..... G03G 15/10

[52] U.S. Cl. ..... 399/249

[58] Field of Search ..... 15/1.51, 256.5, 15/256.51; 430/117; 399/237, 249, 343, 348, 350, 351, 358, 359, 360, 283, 284, 288, 302

[56] References Cited

U.S. PATENT DOCUMENTS

| | | | |
|---|---|---|---|
| 4,659,640 | 4/1987 | Santilli | 430/119 |
| 4,733,273 | 3/1988 | Lloyd | 399/249 |
| 4,878,090 | 10/1989 | Lunde | 399/249 |
| 5,023,665 | 6/1991 | Gundlach | 399/249 |
| 5,191,834 | 3/1993 | Fuhrmann et al. | 101/130 |
| 5,213,931 | 5/1993 | Staples et al. | 430/102 |
| 5,296,645 | 3/1994 | Zwadlo et al. | 118/647 |
| 5,332,642 | 7/1994 | Simms et al. | 430/125 |
| 5,418,104 | 5/1995 | Lawson | 430/110 |
| 5,580,688 | 12/1996 | Hirt | 430/35 |
| 5,608,503 | 3/1997 | Fujiwara et al. | 399/302 |
| 5,640,655 | 6/1997 | Shoji | 399/249 |

FOREIGN PATENT DOCUMENTS

| | | | |
|---|---|---|---|
| 49-112626 | 10/1974 | Japan . | |
| 52-383 | 1/1977 | Japan | G03G 21/00 |
| 53-37431 | 4/1978 | Japan | G03G 21/00 |
| 2-272587 | 11/1990 | Japan | G03G 15/16 |
| 2-149952 | 12/1990 | Japan | G03G 15/10 |
| 4-307574 | 10/1992 | Japan | G03G 15/10 |
| 7-28342 | 1/1995 | Japan | G03G 15/16 |
| 7-210009 | 8/1995 | Japan | G03G 15/16 |
| 10177304 | 6/1998 | Japan | G03G 15/11 |

OTHER PUBLICATIONS

Abstract for JP–4–307574 Dated: Oct. 29, 1992.
Abstract for JP–2–272587 Dated: Nov. 7, 1990.
Abstract for JP–53–037431 Dated: Apr. 6, 1978.
Abstract for JP–7–028342 Dated: Jan. 31, 1995.

*Primary Examiner*—Susan S. Y. Lee
*Assistant Examiner*—Hoang Ngo
*Attorney, Agent, or Firm*—Cohen, Pontani, Lieberman & Pavane

[57] ABSTRACT

A method for applying instant self-fixing adherent printing images from a recording member to a substrate includes applying a liquid toner including toner material and a liquid carrier to a latent image on a ferro-electric recording member, removing an excess amount of the liquid carrier from the adherent image using an extraction mechanism, and transferring the adherent image without the excess liquid carrier to a substrate. The present invention also includes a apparatus for performing the inventive method.

21 Claims, 10 Drawing Sheets

METHOD OF AND MEANS FOR SELF-FIXED PRINTING FROM FERRO-ELECTRIC RECORDING MEMBER

FIELD OF INVENTION

This invention relates to electrostatography, and more particularly to a method and means for self-fixed high speed electrographic printing processes.

BACKGROUND OF THE INVENTION

Electrographic printing is a well known printing process in which an electrostatic latent image is made to attract electrostatic marking particles in a toner. The toner can be of the dry type or of the liquid type. Electrographic printing is particularly applicable when only a relatively small number of prints are required, or when the subject matter is frequently changed, or when part of the subject matter needs to be sequentially changed.

Dry powder toners have many disadvantages when used in such a process. For high speed, long run printing, cost per page is a principle consideration. In particular, the cost of fusing the image to paper or any other desired substrate significantly contributes to the running costs of such a printer. Other objections are related to the problem of dusting; dust, or fine or small particles of toner are prone to escape from the developer, and these deposit onto any surface both within and outside the printing device, causing mechanical failures within the device and environmental problems outside the device. This problem becomes severe when such printing devices are run at high speed. Other disadvantages include, cost of the general maintenance of the press and cost of the dry powder toner.

It is known that latent electrostatic images can be developed with toner particles dispersed in insulating or non-polar liquids. Such toner particles normally comprise colouring matter such as pigments which have been ground with or otherwise combined with dispersing resins or varnishes or the like. Additionally polarity control or charge directing agents are usually included to control the polarity and charge mass ratio of the toner particles. Said dispersed materials are known as liquid toners or liquid developers. In use, a liquid developer is applied to the surface of a support bearing a charge pattern to develop an electrostatic image on the support.

The developed latent image is fixed to the surface, or upon transfer to a subsequent substrate, generally by heating to temperatures above room temperature to fuse the toner image to the substrate. A number of methods can be employed to achieve fixation to a substrate, for example, IR or UV radiation, solvent vapour, or a number of other techniques or combinations thereof commonly employed by those skilled in the art. As can be appreciated, the above mentioned methods of fixing the toner image to the substrate can be characterised by high energy consumption and or can be environmentally undesirable, slow, or a combination of these.

Liquid developer toner particles can also have combined therewith fixing materials which are commonly but not necessarily thermoplastic polymeric materials. Such fixing materials when incorporated into the toner may affect other physical properties, thereby reducing the mobility of said toner particles thus making such a toner not suitable for high speed electrographic printing.

Devices using liquid electrographic printing also have a number of objectionable problems, especially when these devices are required to operate at high speed. The main problem is in regard to the solvent carry-out. The term solvent carry-out relates to the quantity of solvent or carrier which is trapped within the paper. Such solvent subsequently evaporates during image fusing, giving rise to atmospheric pollution and also adding significantly to production costs. A further disadvantage of liquid toning is the tendency for deposition of colouring matter in non-image or background areas which results in a general discolouration of the copy, normally referred to as background fog.

To overcome the above mentioned undesirable characteristics of liquid developers, a number of methods have been proposed.

According to U.S. Pat. No. 4,659,640 issued Apr. 21, 1987, to Santilli, an electrostatic developer liquid is disclosed wherein a wax dispersed in the liquid carrier is described, thus rendering the developer self-fixing at room temperature.

Also, disclosed in U.S. Pat. No. 4,507,377 issued Mar. 26, 1985, to Alexandrovich, a developer composed of a compatible blend of at least one polyester resin and at least one polyester plasticiser. This composition providing a self-fixing liquid electrographic developer.

The above cited examples, although providing self fixing, impose process limitations. The formulations disclosed and self-fixing adjunct therein, limit the electrophoretic development rate of the liquid toner particles. In a high speed electrographic printing press such formulations would not be able to sustain adequate density and self-fixing characteristics at elevated printing speeds in excess of 1 meters per second.

The teachings of U.S. Pat. No. 5,558,970 issued Sep. 24, 1996 to Landa et al., discloses a method of treating a developed image prior to transfer to a final substrate. This process involves enhancing the cohesiveness of the developed image by either physical or chemical means. The application of heat from a radiant energy source for example, or by catalysis are two methods disclosed. It can be appreciated however by those skilled in the art that the above disclosed teachings have the drawback of further expenditure of energy as well as increased solvent evaporation giving rise to greater atmospheric pollution and also adding to production costs. The addition of a catalyst to the developed image, for example, adds a process step which complicates and further limits the process speed of the printer. The image on the final substrate still requires further fusing in addition to the above disclosed step of increasing the cohesiveness of the developed image, again further limiting the process speed of a printer.

U.S. Pat. No. 3,907,423 issued Sep. 23, 1975, to Hayashi et al., teaches a method and means of extracting excess developer liquid to reduce solvent carry-out by mean of an extractor roller.

Further, U.S. Pat. No. 4,286,039 issued Aug. 25, 1981, to Landa et al., teaches of a method of using a deformable polyurethane roller as a squeegee or blotting roller.

U.S. Pat. No. 5,023,665 issued Jun. 11, 1991, to Gundlach, discloses an apparatus for removal of excess carrier liquid, consisting of an electrically biased electrode having a slit therein coupled to a vacuum pump to remove unwanted carrier liquid.

Again, the above cited disclosures, although providing reduced solvent carry-out, also impose process speed limitations. The methods disclosed therein, are not sufficiently reliable at high machine process speeds. In a high speed electrographic printing press such methods would not be able to sustain adequate solvent extraction at elevated printing speeds in excess of 1 meters per second.

U.S. Pat. No. 3,722,994 issued Mar. 27, 1973, to Tanaka et al., teaches of a method of using a corona discharge device for removing any residual developing solution from an imaging member.

Yet again, the above cited disclosure, although providing reduced solvent carry-out, has a number of adverse affects, which may be time dependent, on many latent image bearing members as would be appreciated by those skilled in the art. The method disclosed is also not sufficiently reliable at high machine process speeds. In a high speed electrographic printing press such a method would not be able to sustain adequate solvent extraction at elevated printing speeds in excess of 1 ms−1. In a yet further contrapositive, this method produces substantial environmentally undesirable ozone generation.

SUMMARY OF THE INVENTION

It is the object of this invention to provide a method and means for high speed printing wherefore a toned image is transferred onto a range of substrates at ambient temperature, with self-fixing properties being surprisingly exhibited instantly subsequent to transfer and without the need for subsequent chemical reaction(s), application of heat and/or pressure, nor any other means where energy is actively consumed for fixing of the image.

BRIEF DESCRIPTION OF THE INVENTION

In one form, therefore, although this may not be the only or the broadest form the invention is said to reside in a method of high speed self-fix printing comprising the steps of:

(a) applying a liquid toner including toner material and a liquid carrier to a latent image on a ferro-electric recording member to form a developed image on the recording member, (b) removing excess carrier from the developed image by means of an extraction mechanism to give an adherent image, and (c) transferring the adherent image to a substrate, thereby instantly providing a fixed image on the substrate without a further step or steps of fixing of the image to the substrate.

In a further form the invention is said to reside in a method of high speed self-fix printing comprising the steps of:

(a) applying a liquid toner including toner material and a liquid carrier to a latent image on a ferro-electric recording member to form a developed image on the recording member, (b) removing excess carrier from the developed image by means of a vacuum extraction means to give an adherent image, and (c) transferring the adherent image to a substrate, thereby instantly providing a fixed image on the substrate without a further step or steps of fixing of the image to the substrate.

Preferably the liquid toner is of a type having highly mobile toner particles which when the liquid carrier is at least partially removed therefrom provides an adherent deposit.

Preferably the toner is applied to the recording member by means of a donor roller system.

The invention may further include a step between step (b) and step (c) of transferring the developed image to an intermediate member before transferring the developed image to the substrate.

The invention may further include a step of further removing excess carrier from the developed image by means of a second vacuum extraction means on the intermediate member.

The invention may further include a step of applying a layer of carrier liquid onto the intermediate member before transferring the developed image thereto.

There may be further included a step after step (c) of cleaning the recording member using carrier liquid by means of a cleaning unit.

Preferably the excess carrier and excess toner material removed by the vacuum extraction means or the second vacuum extraction means is recycled. It may be noted that the toner material in the recycled toner liquid is not agglomerated and the recycled liquid toner can be directly re-used as a liquid toner.

The invention is particularly applicable for the high speed printing of continuous webs of paper. The printing according to this invention may be done with web speeds of up to approximately 10 $ms^{-1}$ (meters per second).

The vacuum extraction means or the further vacuum extraction means may be operated at a vacuum of from 1 to 80 kPa.

Preferably the latent image is formed on the recording member by digital means.

The printing according to this invention may be a high speed self-fix multi-colour printing process with multiple printing stages.

In a further form the invention is said to reside in an apparatus for high speed self-fix electrographic printing comprising (a) a ferro-electric recording member, (b) means to form an electrostatic latent image on the recording member, (c) means to supply a liquid toner comprising toner particles and a carrier liquid to the latent image to develop the latent image, (d) means to remove excess carrier liquid from the developed latent image, (e) a transfer station to transfer the developed latent image after removal of excess carrier liquid to a substrate, and (f) recycling means to transfer the removed excess carrier liquid back to the means to supply liquid toner.

In an alternative form the invention is said to reside in an apparatus for high speed self-fix electrographic printing comprising (a) a ferro-electric recording member, (b) an electrostatic image deposition device to form an electrostatic latent image on the recording member, (c) means to supply a liquid toner comprising toner particles and a carrier liquid to the latent image to develop the latent image, (d) a vacuum extraction device to remove excess carrier liquid from the developed latent image, (e) a transfer station to transfer the developed latent image after removal of excess carrier liquid to a substrate, and (f) recycling means to transfer the removed excess carrier liquid back to the means to supply liquid toner.

The means to supply liquid toner may comprise a donor roller arrangement.

The apparatus may include an intermediate member between the recording member and the transfer station.

The means to remove excess carrier liquid from the developed latent image on the recording member may comprise vacuum extraction means.

There may be further included vacuum extraction means to remove excess carrier liquid from the developed latent image on the intermediate member.

The vacuum extraction device and the further extraction device may provide a vacuum of from 1 to 80 kPa.

The vacuum extraction device and the further extraction device may include an elongate slit through which the vacuum is drawn and extending transverse to the direction of travel of the recording member and the intermediate member, the slit being spaced from the respective member by from 0.05 to 5 mm and having a width of from 0.5 to 5 mm.

The transfer station may comprise a transfer roller.

The means to form the electrostatic latent image on the recording member may comprise digital means.

The apparatus may further include a cleaning unit adapted to clean the recording member and/or a cleaning unit adapted to clean the intermediate member.

The cleaning unit adapted to clean the recording member may also be adapted to apply a layer of carrier liquid to the recording member.

The cleaning unit adapted to clean the recording member may also be adapted to apply a layer of carrier liquid to the intermediate member.

The cleaning unit of these embodiments of the invention may comprise a driven cleaning roller, means to apply carrier liquid to the respective member before it reaches the cleaning roller and extraction means to remove excess carrier liquid from the respective member.

The apparatus may further include a recycled toner material and air separator. The separator may comprise a housing having an inlet for extracted toner and air, a baffle assembly around the inlet and an air exit and a toner outlet outside the baffle assembly, the air exit being connected to a source of reduced pressure.

The apparatus for high speed electrographic printing may be for multi-colour printing and hence include a plurality of printing stages of the type disclosed above.

The present invention is particularly adapted to the repeat toning of latent images contained on or about the surface of ferro-electric recording members and allows the use of appropriate liquid toners which overcome many of the disadvantages of the prior art. Further, such compositions of liquid toner and the means of toning and transferring the image deposit to the substrate as described requires no fusing or fixing of the deposit whereupon such deposits are scuff free to a degree expected for normal handling and process purposes. That is, no additional energy of any form is required to cause fixing of the image to the substrate thereby substantially reducing the complexity of the printing system as well as significantly diminishing the printing costs.

Further, an embodiment of this present invention is that of a self-regulating electrographic printing press and as such is able to operate at any printing speed required and not limited to any particular speed. It can be operated at slow electrographic printing speed, generally 0.1 $ms^{-1}$ to very high electrographic printing speed, generally 10 $ms^{-1}$ or any incremental speed therebetween, although a printing speed of 1 $ms^{-1}$ to 5 $ms^{-1}$ or any incremental speed therebetween is preferred.

Such high speed electrographic printing is in part possible due to the persistent internal polarisation of the ferro-electric recording member not requiring downloading of the digital information for every print revolution thereby facilitating a rapid printing process. The data is downloaded to the write-head and subsequently to the ferro-electric imaging member prior to the start of a print run or during a run. It will be understood however that if any additional data is added to the latent image during actual printing, the printing speed will be limited by the download time of the print-head.

Preferably the toner is charged onto the development roller by means of a development process which is characterised by the generation of a wave form in the liquid toner dispersion. Such toning is described as hydraulic meniscus toning, as disclosed in U.S. Pat. No. 5,213,931 issued May 25, 1993 to Staples et al., the entire contents of which are expressly incorporated herein by reference. In such toners it is desirable to maintain a low electrical conductivity, and to ensure that particles are kept as discrete entities, without interconnection to each other by mechanical or electrical binding.

Such toners are in general, characterised by a structure in which the pigment is surrounded or encapsulated by the associated polymers in such manner that the surface of the particle is substantially smooth, however, with the suitable selection of such polymer(s) with respect to the properties of the carrier, the particle surface can show somewhat of a tacky character and upon removal of excess carrier from the toner deposit on the recording member such as the ferro-electric recording member by means of the vacuum extraction means, and subsequent transfer to the printing substrate, the said toner particles become firmly bonded to the substrate, enhanced to some degree by evaporation and absorption of the small amount of carrier which is transferred as an adjunct to the particles.

A further advantage of such a toner system is that the recycled toner is able to be reused without there being resins in the carrier which may become out of balance with other components in the toner composition.

A toner as described in U.S. Pat. No. 5,418,104 issued May 23, 1995, to Lawson, the entire contents of which are expressly incorporated herein by reference, permits high mobility during meniscus toning as disclosed in U.S. Pat. No. 5,213,931, issued May 25, 1993, to Staples et al., due to the smooth surface structure but when excess carrier is removed from the deposit on the recording member, the prior-to discrete particles tend to become adherent and interconnect to form a network such that efficient transfer is realised, without individual toner particle displacement or dislodgment whereupon high image resolution is maintained and when the now tacky network of particles become incident onto the printing substrate, near instant secure bonding of the said network of particles to the substrate is achieved without the need for subsequent fixing.

As disclosed in U.S. Pat. No. 5,418,104 issued May 23, 1995, to Lawson, toner materials useful with respect to this invention, comprising essentially of discrete toner particles in suspension within a dispersant of low electrical conductivity to inhibit electrical binding of the toner particles, the discrete toner particles comprise pigment particles surrounded by a layer of electrically insulative thermoplastic polymer and a plasticiser, therefore, the toner particles are essentially discrete in form and devoid of surface protuberances in order to inhibit mechanical binding between particles; and wherein said electrically insulating thermoplastic polymer of the toner material is selected from the group consisting of acrylics, acrylic copolymers, polyethylene, and polyethylene vinyl acetate copolymers.

The toner particles which comprise pigment particles surrounded by a layer of electrically insulative thermoplastic polymer and a plasticiser, suspended within a dispersant or carrier liquid, when placed in an external electric field, as provided by the ferro-electric recording member and intensified by the donor member, move rapidly to the latent image and deposit thereon. This rapid toner particle movement or high particle mobility is a fundamental requirement of any high speed electrographic process and this invention takes advantage of a particle as disclosed in Lawson which has a well defined somewhat spherical geometry with no network of particles which would significantly impede the toner particle motion, whereby dramatically reducing mobility. Also disclosed in Lawson the fixing agents or materials as described, are an integral constituent of the toner particles and are not present in the carrier liquid at any significant concentration, such that very high particle mobility can be attained, as toner particle drag is defined by the viscosity of the carrier liquid whereas inclusion of the fixing agent or the like in said carrier consequentially increases the viscosity of the carrier whereupon particle drag is increased and mobility, substantially decreased.

Excess carrier removal can be by many means including vacuum suction as disclosed in U.S. Pat. No. 5,023,665 issued Jun. 11, 1991, to Gundlach, the entire contents of which are expressly incorporated herein by reference, reversing roller as disclosed in U.S. Pat. No. 3,907,423 issued Sep. 23, 1975, to Hayashi, the entire contents of which are expressly incorporated herein by reference, or a solvent limiting device as disclosed in U.S. Pat. No. 3,722, 994 issued Mar. 27, 1973, to Tanaka et al., the entire contents of which are expressly incorporated herein by reference, however, vacuum suction is a preferred embodiment as it allows excellent control of the quantity of carrier liquid removed at elevated printing speeds exceeding 1 ms−1, thereby assisting networking of the toner particles of toned image such that near dry transfer of the image to receiving member can be achieved with the excess carrier liquid being readily reclaimed and added to the dispersed toner in such manner that the working strength toner is reconstituted at a desired solids concentration so as to permit the said carrier to be reused; that is said carrier virtually constitutes a printing assembly element and not a consumable commodity although small amounts of said carrier are indeed lost from this embodiment as will be apparent to those skilled in the art. A further advantage of the use of vacuum extraction means is that in those areas of the electrostatic latent image in which there is no charge, stray toner particles may be removed along with excess carrier thereby reducing the amount of background fog on the final image.

A particular advantage of using a ferro-electric recording member is that the persistent internal polarisation which supports the latent image allows for the use of a high vacuum and hence limiting the quantity of carrier liquid associated with the image deposit on the said recording member such that a minimum quantity of said carrier liquid is carried-out to the printing substrate whereby environment and cost considerations are fulfilled.

Again as those skilled in the art will appreciate, this so described transfer criterion is stringent, however, it can be seen that in accordance with the construction of a toner particle with the required properties of encapsulation with a well defined albeit somewhat tacky when in a continuous carrier environment but essentially smooth outer surface, essentially allows the said criterion to be met, in that prior to transfer but after image development, a prescribed quantity of carrier liquid is removed from the toner deposit which facilitates changes to the surface of these particles thereby permitting the instant formation of a network of interlinked deposited toner particles such that the deposit becomes integral which upon the application of the transfer condition, facilitates image transfer as a single entity thus accomplishing instantaneous self-fix upon placement of the image onto the final substrate, via an intermediate member if desired, but without the displacement of individual particles which in other systems is believed to be responsible for the tailing, drag or slur problem prevalent in many high speed digital electrostatic printing systems. It can therefore be appreciated by those skilled in the art, that this invention allows instant complete transfer to a wide range of substrates with minimal carrier carry-out together with excellent resolution and image integrity.

A yet further embodiment of this invention is to effect rapid bonding of the image deposited on the final substrate so as to allow manipulation of the paper as is normal printing practice with regards reeling, cutting, collating etc. without the implementation of a fixing station or system of any form, or the application of radiation of any frequency including blackbody radiation, to be incident on or to contact the deposit and or final substrate in any manner; that is, this bonding as herewith described pertains to a bonding at ambient temperature without the need for the application of external forces including those of a chemical nature. Further, at the completion of the printing process, the bonded image exhibits a degree of fix which is consistent with the general requirement of this diligence including scuff, abrasion, skin-oil, crease and eraser resistance.

As discussed earlier an intermediate member may be used between the development roller and the final substrate. For such an intermediate member, the selection criterion for suitable material(s) must include surface energy considerations such that no toner becomes bonded to the intermediate member. There may be placed a thin layer of carrier liquid onto the intermediate such that this layer acts as a mechanical barrier which further reduces the incidence of toner particles encroaching towards the surface of the intermediate member.

The preferred liquid toner is of such a physical nature that the outer constituents of the so described encapsulated or surrounded pigment particles made in accordance with U.S. Pat. No. 5,418,104, issued May 23, 1995, to Lawson, when in their normal state, as dispersed in a carrier such as Isopar L manufactured by Exxon Corporation or the like, behave as if they were somewhat solid particles, that is, although there may be some limited solubility of the polymers that constitute the encapsulation entity, the toner particle will move through the toning, transfer, reclamation and other associated subsystems without film-forming or the like such that any reconstitution of the toner to a designated dispersion environment can be readily achieved many times without destroying the functionality of such particles whereas when the said particle is placed in a near carrier free environment such as that which can be contrived on the recording member before transfer, then and only then can the said networking of toner particles take place. This preferred liquid toner type has been found to display exceptional stability with respect to life in the printing environment but also due to the physical nature of the particle excellent shelf-life.

BRIEF DESCRIPTION OF THE DRAWINGS

To assist with understanding, the invention will now be discussed with reference to preferred embodiments as illustrated in the accompanying drawings in which.

DETAILED DESCRIPTION OF THE INVENTION

Generally this invention describes a method of printing using liquid toners where the latent image on the ferro-electric recording member is toned with the excess carrier being removed and thereafter transferred to a suitable substrate wherein the said image becomes instantly bonded to the substrate without the requirement for additional fixing apparatus of any manner.

Figure 1:
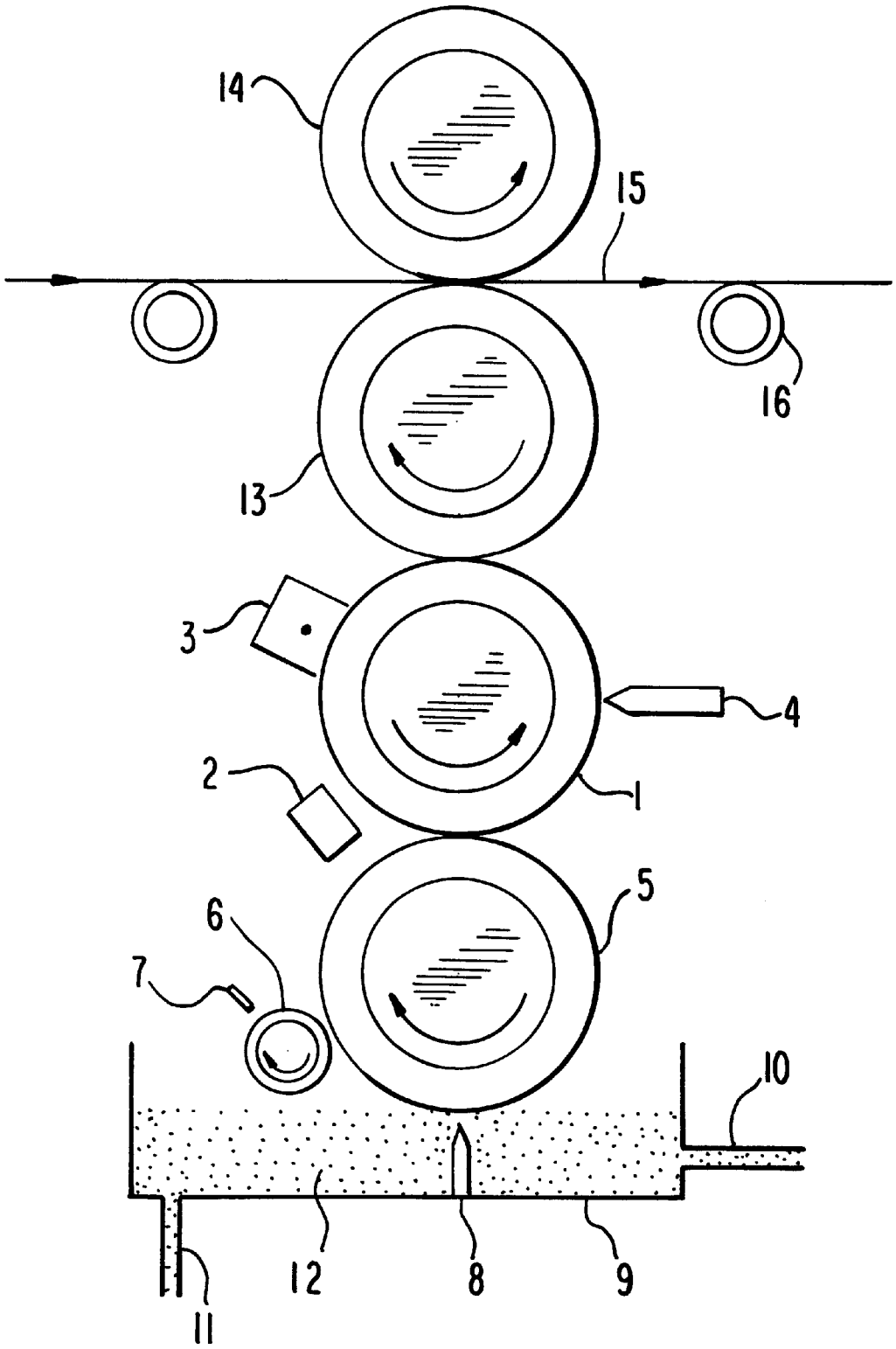
FIG. 1 shows a schematic view of a first embodiment of a high speed electrographic printer according to the invention.

Now looking at the first preferred embodiment in more detail as depicted in FIG. 1 the high speed electrographic printer includes a recording member 1 with a write head 2 adapted to form an electrostatic latent image on the recording member 1.

A latent image charge enhancing device 3 enhances the charge on the recording member 1. To tone the electrostatic latent image a donor roller 5 collects toner from a toner bath 9 as it passes over a weir 8. Excess toner is removed by roller 6 which is cleaned by a scraper 7. Toner is supplied to the toner bath through line 10 and removed through withdrawal pipe 11 for recycling.

A thin layer of liquid toner is carried around on the donor roller 5 to the recording member 1 where it tones the electrostatic latent image.

The toned electrostatic latent image is conveyed around on the recording member 1 and excess carrier liquid and excess toner are removed by vacuum head 4 before the toned image is transferred to an intermediate roller 13. The toned image is carried around on the intermediate roller 13 until it is transferred to the web of paper or other substrate 15 which runs through a nip between the intermediate roller 13 and a transfer roller 14. Paper web 15 is supported on support rollers 16.

Figure 2:
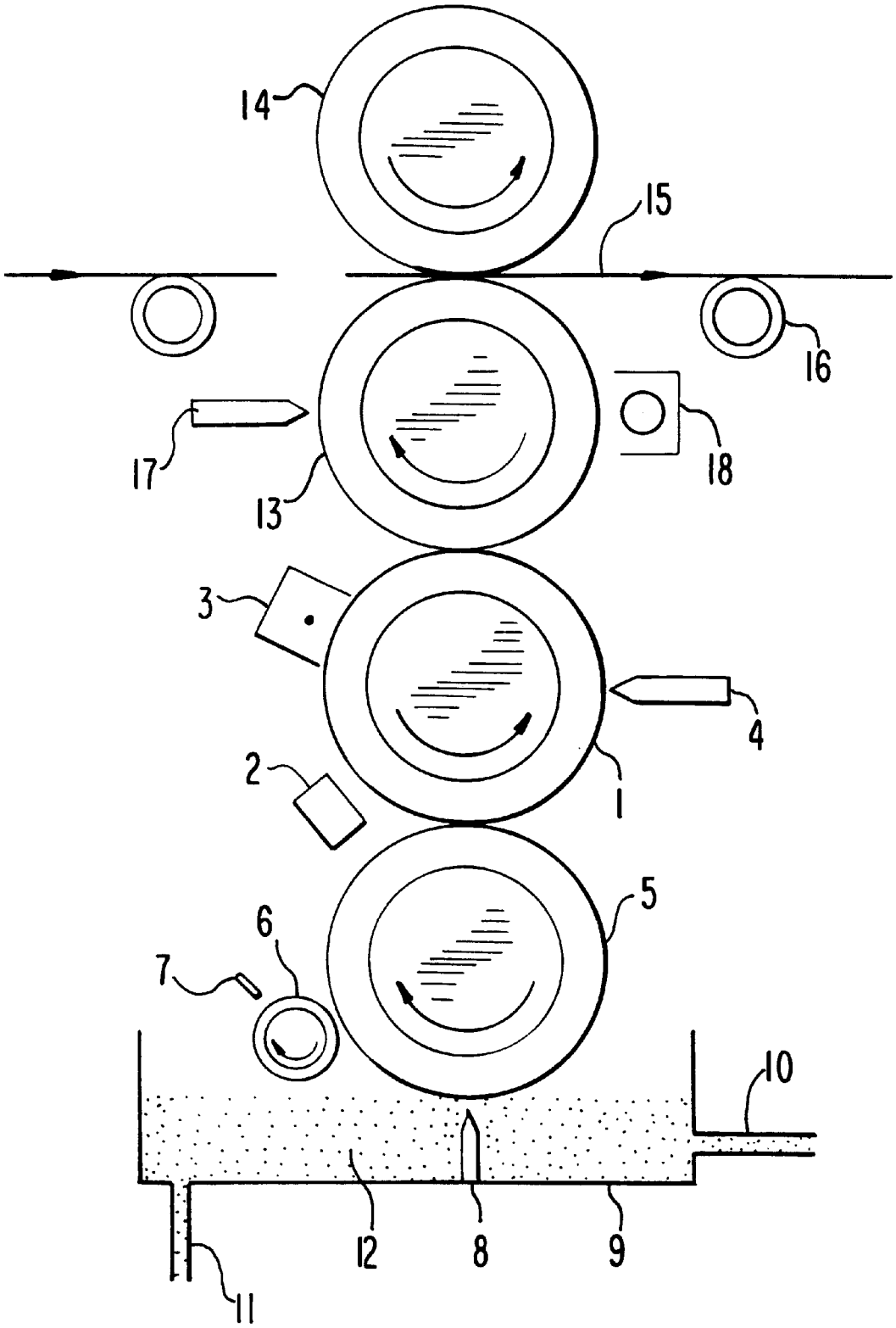
FIG. 2 shows a schematic view of a second embodiment of a high speed electrographic printer according to the invention.

In the embodiment shown in FIG. 2 the process for producing the electrostatic image and toning the electrostatic image as shown in FIG. 1 is the same but after the electrostatic image has been transferred to the intermediate roller 13 a second vacuum head 17 is used to remove more of the excess carrier liquid before the image is transferred to the web 15. A cleaner 18 is used on the intermediate roller to remove any remaining toner before the intermediate member collects the next developed image from the recording member 1.

Figure 3:
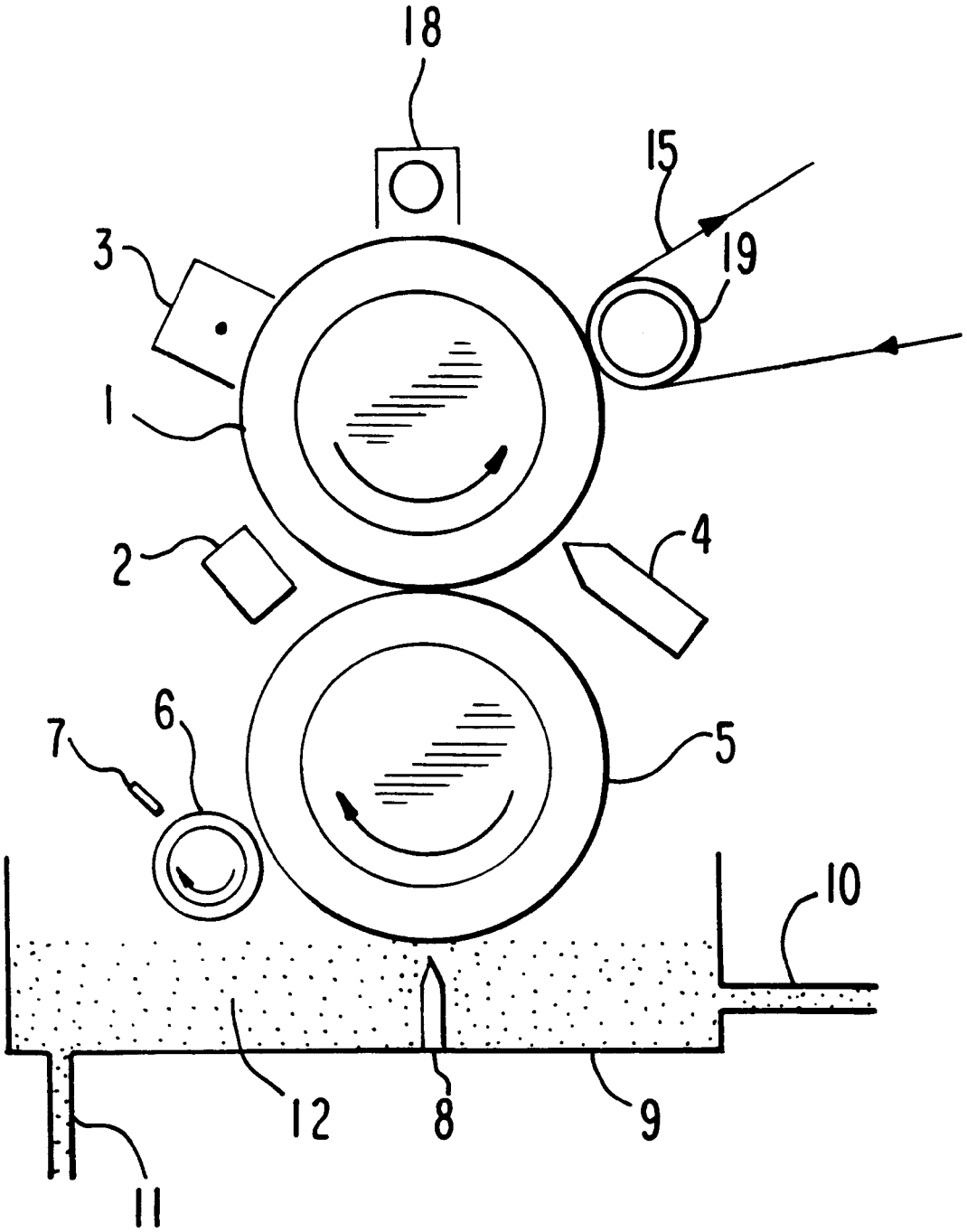
FIG. 3 shows a schematic view of a third embodiment of a high speed electrographic printer according to the invention.

FIG. 3 shows an arrangement of direct transfer of developed images to a web. In this embodiment, the write head 2 produces a latent image onto recording member 1, the recording member has a contrast enhancing device 3 to enhance the latent image on the ferro-electric surface of the recording member. After the electrostatic image is developed a vacuum head 4 removes a majority of the carrier liquid and any stray toner particles before the developed image is transferred to a web 15 rolling over a transfer roller 19. The recording member 1 is then cleaned by cleaner 18 before the charge enhancing device 3 recharges the image.

It is to be realised that with the use of a ferro-electric recording member the write head may not change the latent image at all on the recording member and many exact duplicates of the image may be produced. Alternatively, the write head may change all or a part of the electrostatic image so that for instance a sequential set of numbers may be printed on to copies of an image which is otherwise unchanged.

Further advantages of using a ferro-electric recording member is its capacity to sustain highly resolved latent images as well as the capability of grey scale and continuous tone reproduction as required in the graphic arts field.

Figure 4:
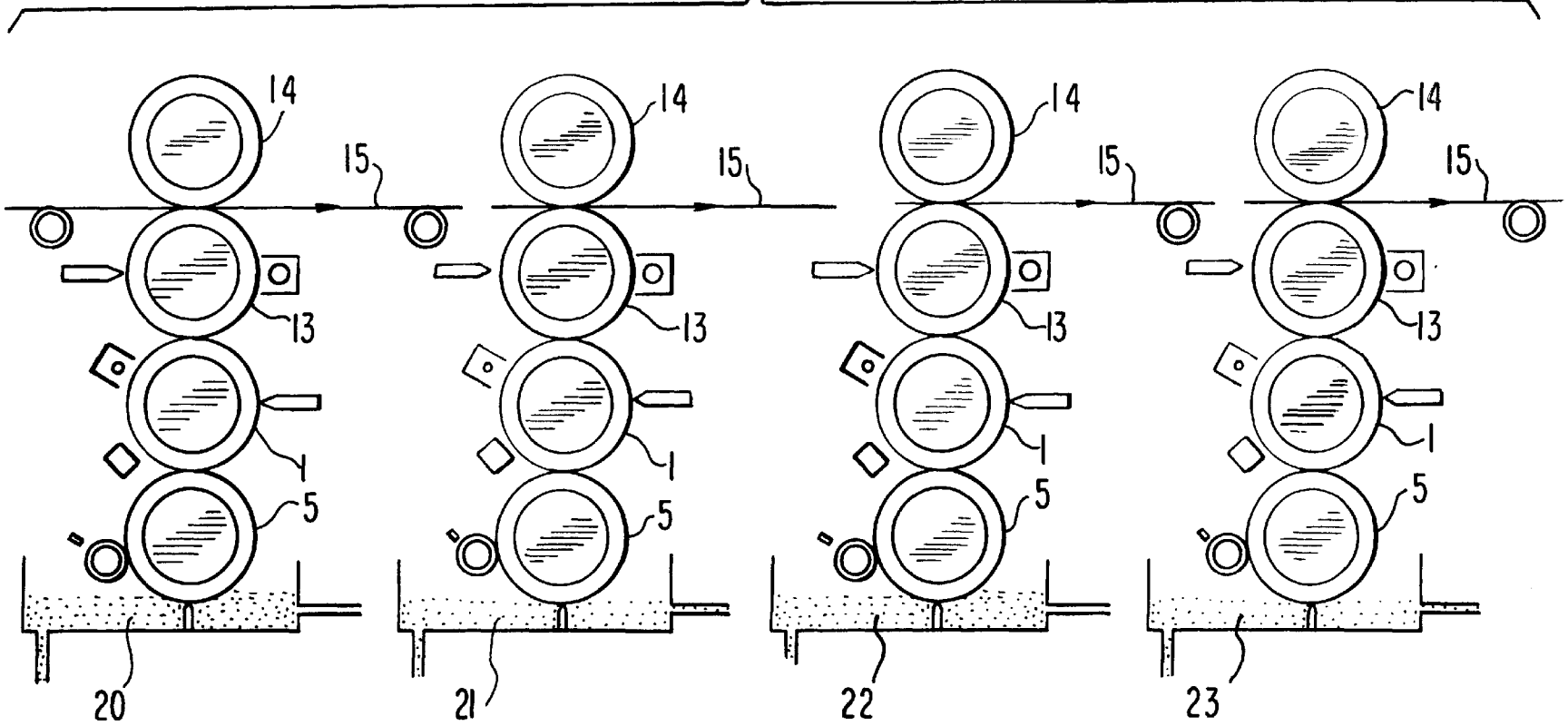
FIG. 4 shows a schematic view of an embodiment of a multi-colour high speed electrographic printer according to the invention.

FIG. 4 shows an arrangement of printing onto a web 15 which may be used for colour printing.

Each stage has a donor roller 5 dipping into a toner bath 20, 21, 22, 23, a recording member 1, an intermediate transfer roller 13 and a transfer roller 14 with the web 15 passing through the nip between respective the transfer roller and the intermediate roller. In the toner bath 20 a toner of a first colour causes an electrostatic image to be toned with the first colour and transferred to the web 15. In the second stage a toner 21 causes electrostatic image of a second colour to be transferred to the web 15 with suitable registration between the first and second stages. Subsequent colours are added from toner tank 22 and 23 once again with suitable registration between the stages so that the web after the four colour printing has a complete colour developed image.

The colours are preferably cyan, magenta, yellow and black. A combination of these or any other special colours may be used.

The sequence of colours in the stages is dependent upon the toner chemistry and opacity and one preferred embodiment the order may be yellow, cyan, magenta and black although other sequences of colour are within the scope of this invention.

Figure 5:
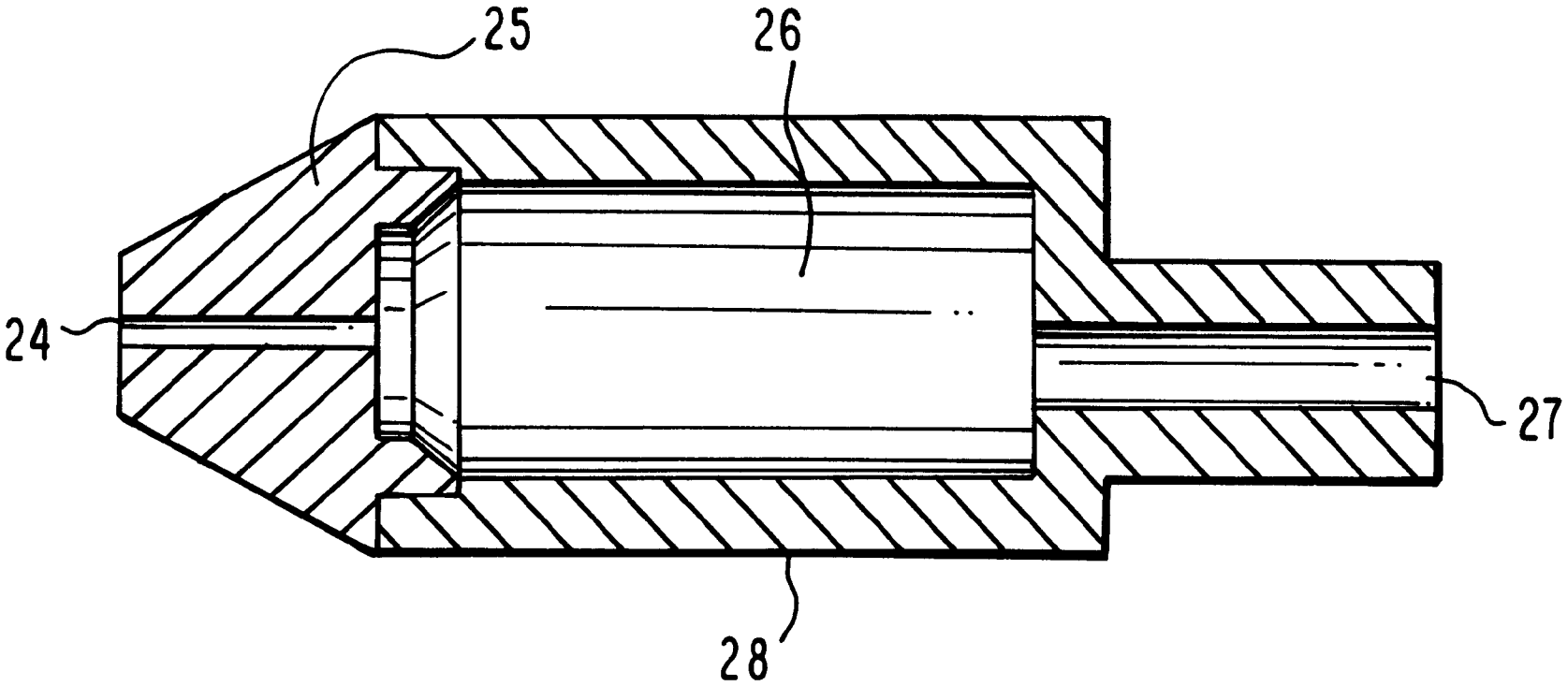
FIG. 5 shows a schematic view of a vacuum extraction head according to the invention.

FIG. 5 shows a schematic view of a vacuum head 4 of the type used in the present invention.

The vacuum head 4 has a nozzle 25 with an aperture 24 in its tip. Vacuum is applied through pipe 27 and excess carrier material is received in tank 26 in the body 28 and then transferred to recycling through pipe 27 under the applied vacuum force.

Figure 6:
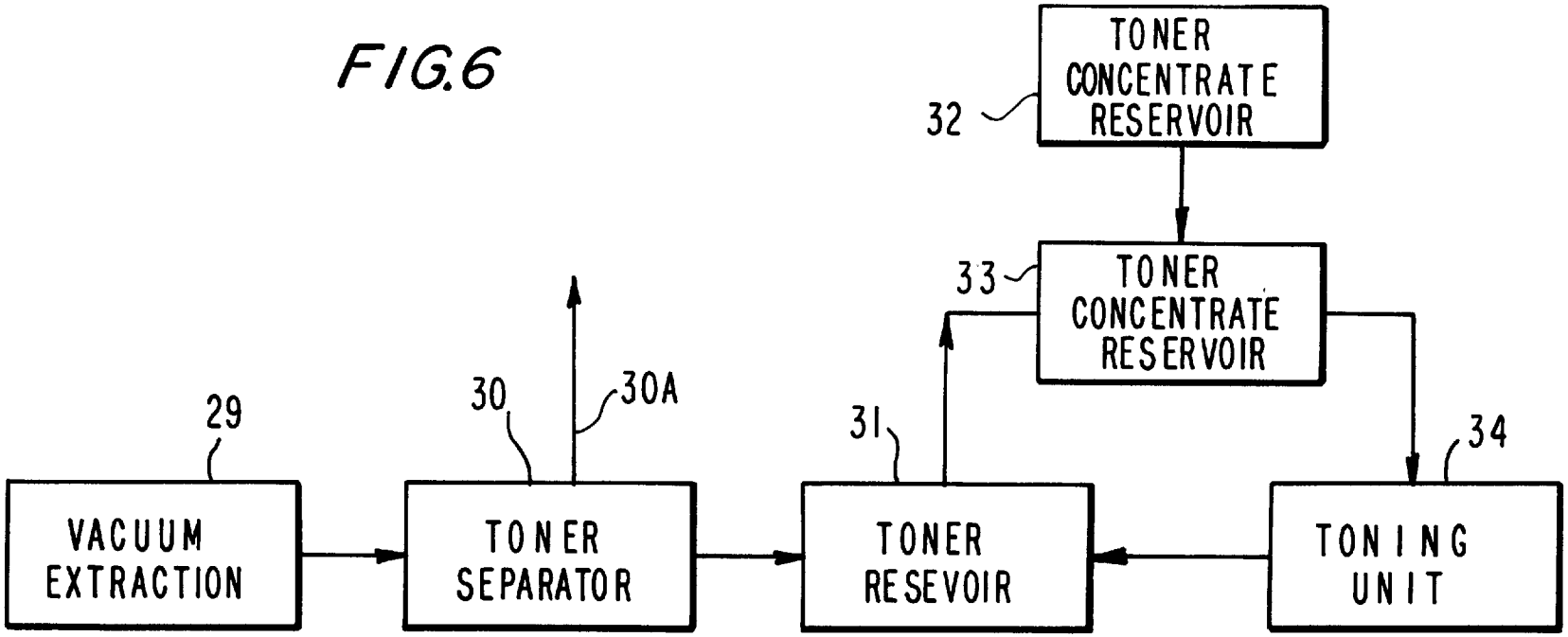
FIG. 6 shows a block diagram of a toner flow and recycle arrangement of the present invention.

In FIG. 6 there is shown a block diagram of toner flow and recycle arrangements for this invention. The vacuum extraction stage 29 extracts stray toner particles and carrier liquid along with air which are transferred to the toner separator 30 where the carrier liquid and toner particles are separated from the air with the liquid and particles being transferred to a toner reservoir 31 and the air passing through line 30A to a source of reduced pressure or vacuum. Toner is then transferred to a toner concentration control unit 33 to ensure that the toner is at the correct working concentration, further toner concentrate can be added from toner concentrate reservoir 32 if the toner concentration control unit determines that the toner requires replenishment and then it is transferred to the toning unit 34 with excess toner being transferred back to the toner reservoir.

Figure 7:
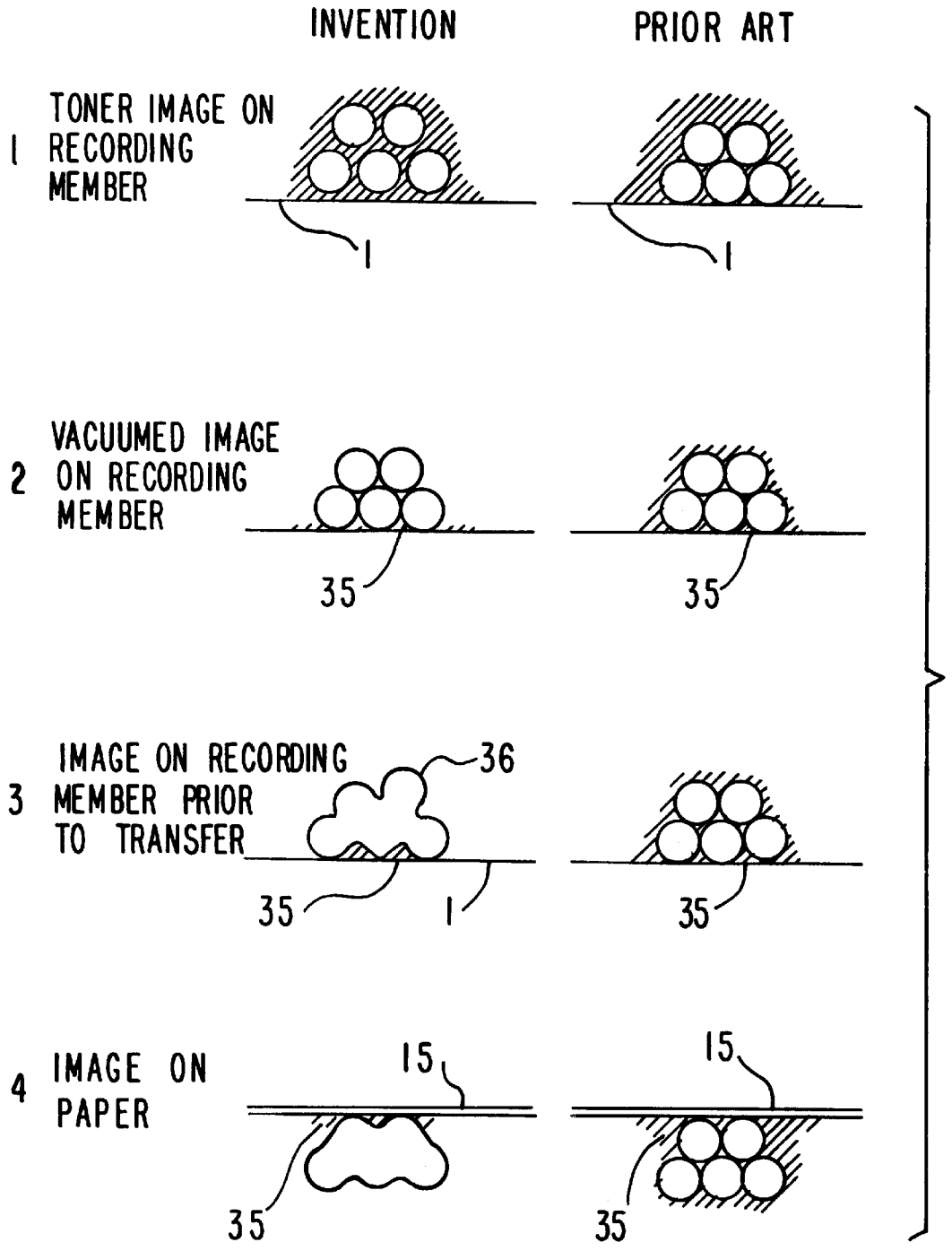
FIG. 7 shows a conceptual view of printing according to the present invention including the process of removal of excess carrier from toner particles and the condition of the resultant developed image of the present invention as compared with the prior art.

FIG. 7 shows a concept of the process for removal of the excess carrier from toner particles and the condition of the resultant developed image of the present invention as compared with the prior art. The applicants believe this may be the process which is occurring in this present invention but do not wish to be bound to this particular explanation.

As shown in stage 1 of the process as shown in FIG. 7 toner particles and carrier liquid have been laid down on the recording member 1. The toned image is transferred to the vacuum stage and after vacuuming as shown in stage 2 for the depiction of the present invention a majority of the carrier liquid 35 has been removed with only a very small amount being below the toner particles. In the prior art depiction vacuuming or other method of carrier liquid removal has left a considerable amount of carrier liquid 35 about the toner particles. Significantly more carrier liquid can be removed in the present invention because of the higher charge on the ferro-electric surface means that a higher vacuum can be used for the extraction of carrier liquid.

After the vacuum stage the particles tend to agglomerate to produce a network of particles 36 in the invention but in the prior art the remaining carrier liquid prevents this from occurring.

In stage 3 the small remaining amount of carrier liquid 35 underneath the adherent network of toner particles acts as a release agent from the recording member 1 so that when the adherent toner particles are transferred to the web 15 there is essentially no carrier at the interface resulting in instantaneous self-fixing. In contrast there is considerable carrier liquid 35 remaining on the toner particles for the prior art which gives poor or slow fix of the toner onto the substrate 15.

This embodiment shown in FIG. 7 is of the direct transfer type as shown in FIG. 3 but if the intermediate transfer type of process or intermediate type transfer with vacuum extraction then a further stage would exist between stage 3 and stage 4 in FIG. 7.

In the various embodiments, the ferro-electric recording member, as disclosed in U.S. Pat. No. 5,191,834 issued Mar. 9, 1993, to Fuhrmann et al., the entire contents of which are expressly incorporated herein by reference, can be polarised as so described such that the domain structure supports persistent internal polarisation in accordance with a permanent latent image which allows repeat toning and transfer without the need to regenerate the image for each print whereby facilitating a rapid printing process in that ripping and down-loading of each rastered image is not required. This method of imaging the ferro-electric recording member is included for illustrating this embodiment whereas other methods may also be utilised with this invention.

The so formed persistent latent image on, in or about the surface of the polarised ferro-electric recording member can, if required, be enhanced that is an enhanced potential difference between positively-polarised regions and negatively-polarised regions thereby increasing the contrast between image and non-image regions.

Methods of contrast enhancing of the latent image on a ferro-electric recording member, as so disclosed in U.S. Pat. No. 5,580,688 issued Dec. 3, 1996 to Hirt, the entire contents of which are expressly incorporated herein by reference, may also be used with the recording member of the present invention.

This contrast enhancement of the latent image allows for the use of high vacuum levels after the development of the latent image because of the increased electrostatic force holding the toner particles to the imaging member, as well as providing improved electrostatic attraction of the toner particles to the latent image and thus increasing development speed and subsequent overall process and hence printer speed.

It is to be understood that the electrostatic printer herein described may be fully automated with the main control consisting of a Print Control Computer incorporating analog and digital interface capabilities. Although some sub-assemblies, transfer station, toning station or re-cycling station for example, may include limited self-regulation, the Print Control Computer may maintain optimum interdependence of the sub-assembly.

A method of toning the latent image contained on the surface of the ferro-electric recording member is disclosed in U.S. Pat. No. 5,213,931 issued May 25, 1993, to Staples et al., the entire contents of which are expressly incorporated herein by reference, although other arrangements with respect to the method of pre-depositing toner onto the donor roller may be applicable.

With the use of alternative recording members such as photoconductors, dielectrics, etc., the forces holding the deposited toner to the surface of the recording member after toning are usually weak because the act of toning the latent image reduces the surface charge density and with the photoconductor dark decay further reduces the force securing the toner deposit to the said member. The preferred ferro-electric recording member does not exhibit these properties as the latent image is supported by permanent internal polarisation of the poled domains within the material, thus the surface charge is largely unaffected by toning and therefore the latitude with regards to the strength and evenness of the vacuum suction is significantly greater than can be reliably utilised with alternative recording members. Moreover, this invention allows extremely high vacuum strength such that after the vacuum suction stage the outer surface of the deposit may be substantially free of carrier thereby allowing extensive toner particle network formation whilst some carrier is intentionally retained at or near the toner deposit-recording member interface such that complete transfer of said image to an intermediate transfer member or any substrate can occur without loss of image resolution or integrity.

Dislocation of all or part of the toned latent image after toning and or during transfer and or after transfer at high printing speeds is virtually eliminated with this embodiment. As is known by those skilled in the art, such dislocations which may be designated as drag, slur, streaming, tailing etc. are usually associated with solid print areas and becomes more conspicuous at printing speeds greater than 1 $ms^{-1}$ when hydrodynamic displacement of the toned latent image may occur. However, as this invention allows the particles of the toned latent image to form networks when the carrier concentration on or about the said particles is reduced by vacuum suction or the like, thereby creating essentially a mat of linked particles which can be transferred as a singe entity which prevents hydrodynamic displacement of individual particles and virtually eliminates drag, slur, streaming tailing etc. at high process speeds. Therefore, inclusion of rigidizing or compacting devices within this embodiment are not required even at printing speeds approaching 5 $ms^{-1}$.

It has been found expedient in some embodiments to juxtapose a carrier wetting mechanism about said intermediate roller to actively control the quantity of carrier at the toner-intermediate member interface to further aid the release of toner from said intermediate member surface thus improving transfer to the final substrate; further such a system allows excellent transfer to a wider variety of papers as well as reducing the quantity of paper dust incident on the recording member whereby contaminating the liquid toner either directly or by the said carrier reclaiming system.

Figure 8:
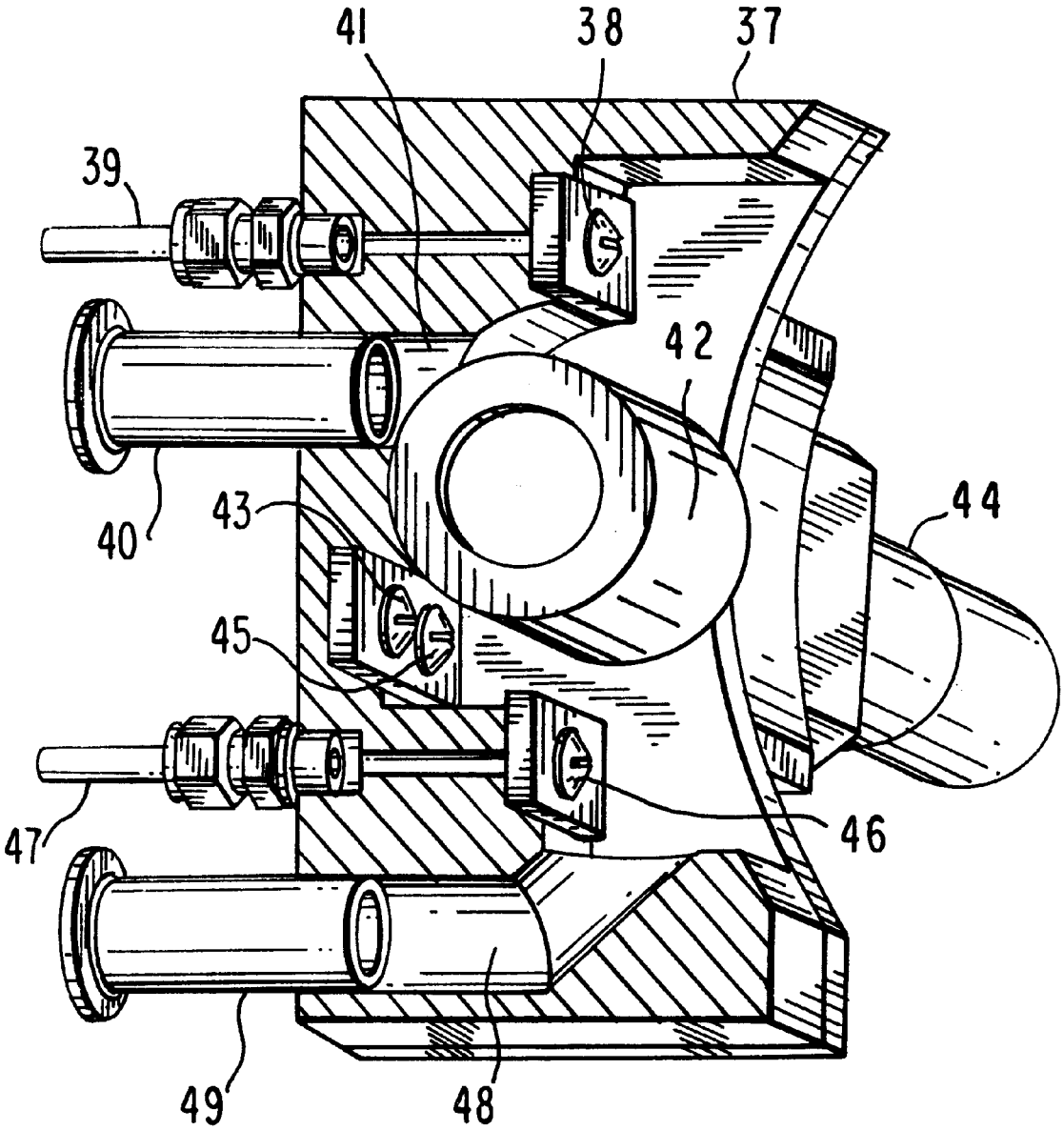
FIG. 8 shows a schematic view of a cleaning unit able to act as a carrier wetting apparatus according to the invention.

Such a carrier wetting mechanism can be incorporated into a cleaning unit. FIG. 8 shows an embodiment of a such cleaning unit as used in this invention. In operation, cleaning unit body 37 supports a roller 42 manufactured of open cell foam or of any other suitable material. The foam roller is urged against the intermediate member and rotated at a predetermined speed by motor 44 to scrub any residual toner deposit left behind after transfer. Carrier liquid is provided by tube 39 for spray jet 38 which wets or softens any residual toner deposit prior to scrubbing by foam roller 42. Excess carrier liquid is removed by vacuum 41 and returned to a collector tank (not shown) through vacuum tube 40. Foam roller 42 is maintained clean by carrier liquid spray jets 43 and 45 being supplied by tube 47. Residual carrier liquid and any residual toner is removed from or about the foam roller by vacuum 41. Carrier liquid spray jet 46 supplied by tube 47 places a final layer of carrier liquid, if required, which can act as a release layer prior to receiving the following developed image from the imaging member. Further control of this final carrier liquid release layer is achieved by vacuum 48 with excess carrier liquid being returned to a collector tank (not shown) through vacuum tube 49. A release layer thickness of between 0.1 to 10$\mu$ has been used with good results but a release layer of 0.5 to 2$\mu$ thickness is preferred.

The above disclosed cleaning unit although primarily disposed as a device for the removal of residual toner not fully transferred to the final web substrate, can be diligent control of the spray jets and vacuum provide a suprisingly well controlled layer of carrier liquid on the surface of the intermediate member to act as a release layer. It is therefore possible to not only clean the surface of the intermediate receiving member prior to further collection of developed images from the recording member, but to also act as a carrier wetting mechanism by placing a controlled carrier liquid layer on the intermediate member to act as a release layer to allow more complete transfer to the final web substrate.

Carrier liquid utilised in the cleaning unit for removing residual toner as well as providing the release layer is totally recycled within the printer, a very small quantity of carrier liquid loss due to evaporation occurs as can be realised by those skilled in the art. Toner contaminated carrier liquid from the cleaning unit is transferred to a collector tank from which it subsequently passes through a number of filters to remove any toner particles. The so filtered carrier liquid is then transferred to a carrier liquid holding tank for re-circulation to the cleaning unit.

The configuration of the vacuum system that provides the negative pressure at the vacuum head, illustrated in FIG. 5, comprises of a unit run by compressed air in which a venturi type system provides negative pressure in a holding tank. Negative pressure is applied to vacuum head(s) through toner separator as illustrated in FIG. 9.

Figure 9:
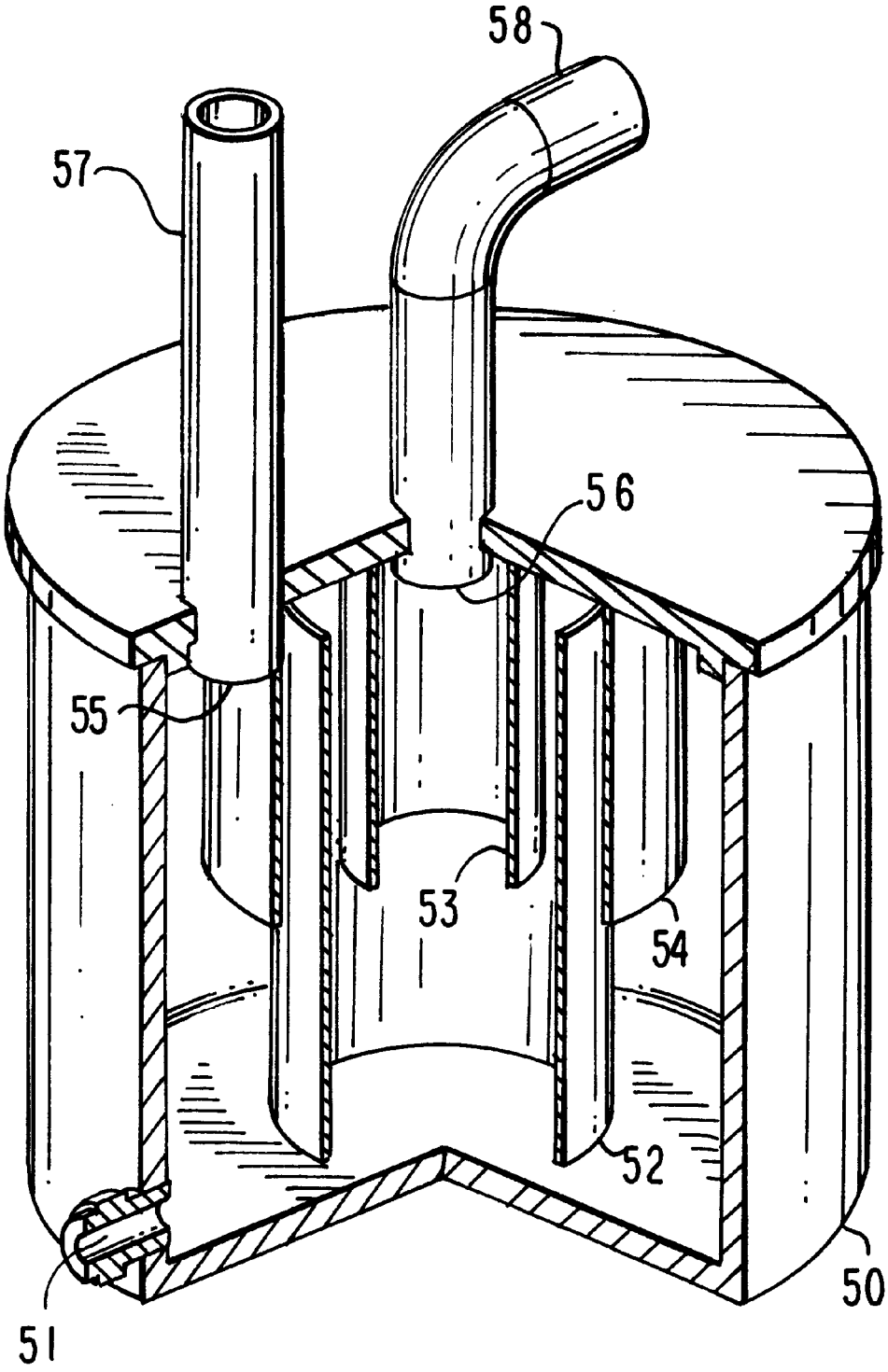
FIG. 9 shows a schematic view of a toner separator according to the invention.

FIG. 9 illustrates the toner separator as used in this invention. The toner separator consists of a housing 50 in which an inlet 56 allows excess toner removed from the developed image by way of the vacuum head via tube 58 to enter the toner separator. Baffles 52, 53 and 54 provide toner separation from the air vehicle provided by the negative pressure holding tank (not shown) via tube 57 and the air vehicle exiting through outlet 55. Separated toner which collects at the bottom of housing 50 is transferred via a pump (not shown) from outlet 51 to the toner reservoir.

It has been surprisingly found that recycled toner, collected by the toner separator illustrated, performs as the virgin toner and does not exhibit toner particle agglomeration as would be expected and realised by those skilled in the art. This unanticipated result in conjunction with the desired embodiments of the preferred toner type provides for full re-cycling of all toner particles scavenged from the developed toner image.

The vacuum system as well as all pumps referred to in this invention are operated by compressed air. This type of system is therefore extremely fire safe.

The configuration of the transfer assembly may be of the direct transfer type where the toned latent image is moved from the recording member directly to paper or alternatively it may be of the intermediate type where the toned latent image is first moved to an intermediate member and then to paper. With respect to this invention the latter, that is intermediate transfer is preferred as it has been found that such a system permits greater control of the quantity of carrier associated with the transferred image in that a second vacuum suction assembly may be juxtaposed about the intermediate member if deemed necessary.

Although electrostatic transfer is preferred, other methods as disclosed in U.S. Pat. No. 5,342,726 issued Aug. 30, 1994, to Lima-Marques, the entire contents of which are expressly incorporated herein by reference, are also applicable; indeed any combination of transfer methods may be used, if so desired; further, for transfer from the intermediate to the final substrate pressure transfer could be employed, however as those skilled in the art would know, pressure transfer from the ferro-electric recording member is difficult in that perturbation of the internal polarisation within the recording member may cause distortion or changes to the latent image; such distortion or changes to the latent image are usually undesirable with repeat mode printing.

Vacuum suction is an excellent control of the quantity of carrier liquid removed at elevated printing speeds exceeding 1 $ms^{-1}$, thereby assisting networking of the toner particles of the toned image such that near dry transfer of the so formed adherent image to a receiving member can be achieved.

Figure 10:
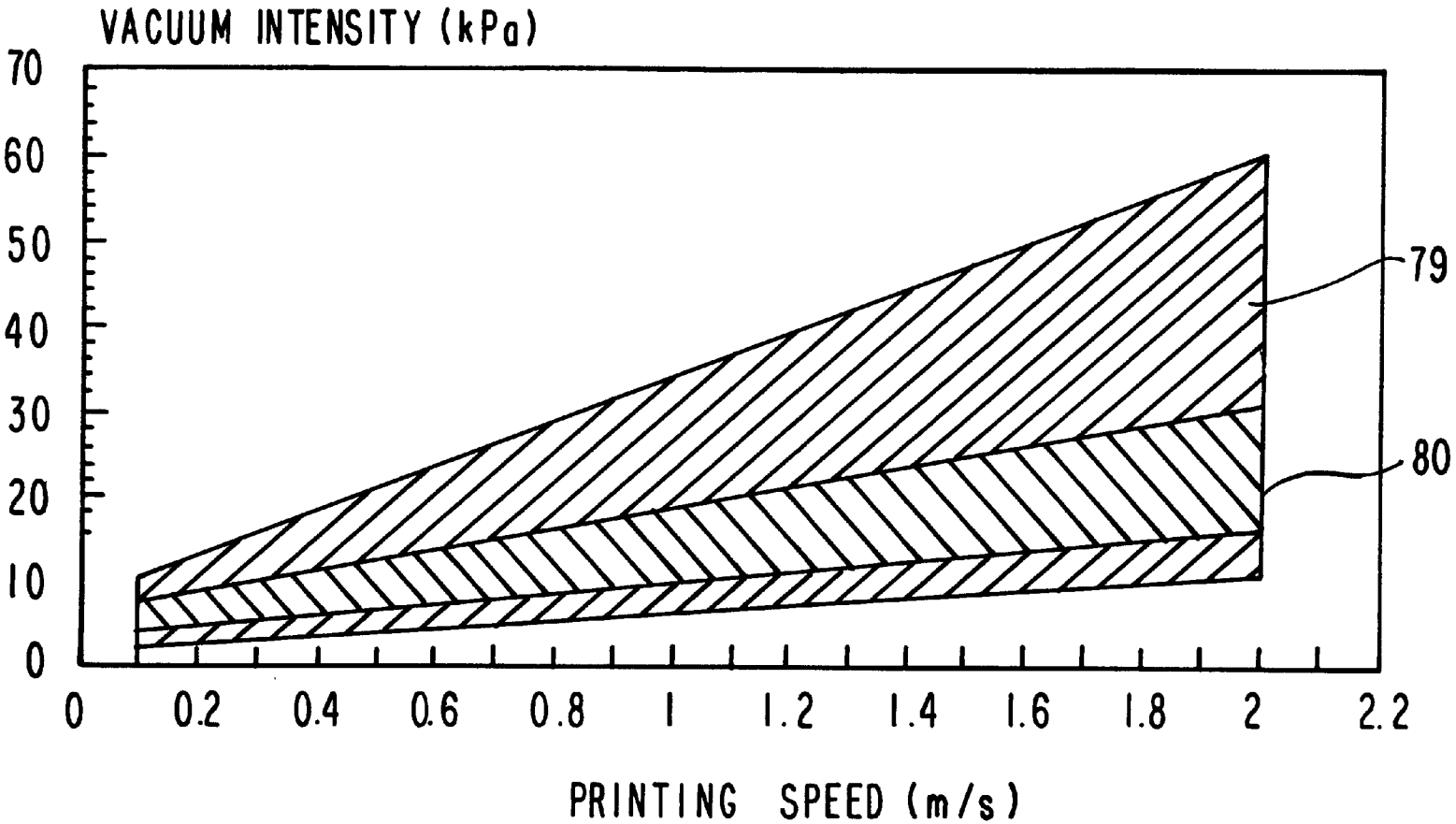
FIG. 10 shows a graphical representation of an example of vacuum intensity as used in the invention.

FIG. 10 shows a graphical representation of an example of vacuum intensity utilised in this invention. The figures disclosed are for an experimental vacuum head as shown in FIG. 5 with an aperture 24 of the dimensions of 2 mm in width and 54 mm in length. Light shaded area 79, in FIG. 10, shows useable vacuum intensity for a given print speed and dark shaded area 80 shows the preferred vacuum intensity for a given print speed. As can be realised by those skilled in the art, for speeds exceeding 2.0 $ms^{-1}$ the vacuum intensity would be increased accordingly. The preferred vacuum intensity as represented with dark shaded area 80 provides the developed image transferred to paper, using the preferred toner formulation, with a degree of fix which is consistent with the general requirement of this diligence including scuff, abrasion, skin oil, crease and eraser resistance. At a print speed of 0.1 $ms^{-1}$, a vacuum intensity of 2 kPa to 10 kPa has been used, with a preference of 4 kPa to 8 kPa. At a print speed of 1.0 $ms^{-1}$, a vacuum intensity of 6 kPa to 34 kPa has been used, with a preference of 9 kPa to 18 kPa. At a print speed of 2.0 $ms^{-1}$, a vacuum intensity of 10 kPa to 60 kPa has been used, with a preference of 14 kPa to 28 kPa. The vacuum intensity can be varied in accordance with an algorithm in the Print Control Computer to optimise carrier extraction and image quality during a print run; vacuum intensity can be increased or decreased dependent on the print speed, thus maintaining optimum print conditions.

In a production electrostatic printer, the dimensions of the vacuum head and the vacuum intensities, would be commensurate with the width of the paper web being printed. The intensity figures are measured in tank 26 as shown in FIG. 5. Other vacuum head aperture dimensions can be used but vacuum intensity levels would need to be adjusted accordingly. The vacuum head to recording member gap can be varied as required; dependent on latent image surface charge and toner characteristics for example. The vacuum head to imaging member gap, for example, can also be varied in accordance with an algorithm in the print Control Computer to optimise carrier extraction and image quality during a print run, this gap can also be varied as print speed is either increased or decreased, thus maintaining optimum print conditions. A vacuum head to recording member gap of the order of 0.05 mm to 5.0 mm has been used, although a gap of 0.1 mm to 1.0 mm is preferred.

It will be understood that lower or higher vacuum intensity as represented in FIG. 10 can be used. Higher intensity will tend to produce low density images for example; excessive toner will be scavenged from the developed image. Also, the developed image will tend to be too dry and therefore exhibit poor transfer characteristics. If inadequate vacuum intensity is used the developed image, because of excess residual carrier left on the recording member, will exhibit not only higher background fog but also increased carrier liquid carry-out to the paper web. Further, the developed image on transfer to the paper web will not exhibit instantaneous self-fix to the desired degree.

Although the mechanism for the bonding of the network of adherent toner to the final substrate is not well understood, it is believed that the nature of the near continuous lateral toner deposit when placed on the substrate with substantial force in terms of both electrical and mechanical potential, instantly and continuously conforms to the surface of substrate with the extremely small quantity of carrier present at this interface being sorbed into the substrate after this initial bonding process has been completed. It must be emphasised that the upper or outermost surface of the deposit as it exists on the recording member, experiences the most intense suction and is therefore substantially free of carrier which facilitates this said instant bonding of the image to the substrate. If, however, the mechanical potential or pressure for transfer is too high then image distortion in the form of image squash or the like will be evident especially with high speed operation; conversely, if the force is to low, poor transfer efficiency will be observed as well as poorer bonding to the final substrate. It must be understood the act of bonding is near instantaneous, the precursory steps of carrier removal and the so formed adherent deposit having occurred at some time and place prior to the image becoming incident onto the final substrate; that self-fix as described in this invention is believed to be a two stage process.

The described invention provides a method and means for high speed electrographic printing wherefore a toned image is transferred onto a range of substrates at ambient temperature, with self-fixing properties being exhibited immediately after transfer and without the need for subsequent treatment. This invention therefore provides for lower operating costs due to low energy consumption as well as providing very low carrier liquid consumption thus reducing environmental impact by virtually eliminating solvent release into the atmosphere. Furthermore, the described invention allows for the complete re-cycling of toner without any loss of quality of subsequent developed toner images utilising the recycled toner. Yet further, the described invention, due to its re-cycling capability, provides an economically viable high speed digital electrostatic printing system.

Throughout this specification various indications have been given as to the scope of this invention but the invention is not limited to any one of these but may reside in two or more of these combined together. The examples are given for illustration only and not for limitation.

What is claimed is:

1. An apparatus for high speed self-fix electrographic printing, comprising:

(a) a ferro-electric recording member, (b) means for forming an electrostatic latent image on said recording member, (c) means for supplying a liquid toner comprising toner particles and a carrier liquid to said latent image to develop latent image, said means for supplying comprising a donor roller operatively arranged for inking said ferro-electric recording member with said liquid toner, (d) means for removing an excess amount of said carrier liquid from said developed latent image, (e) a transfer station transferring said developed latent image after removal of said excess amount of said carrier liquid to a substrate, wherein an amount of said carrier liquid removed from said latent image by said means for removing allows a self-fix of said developed latent image on said substrate upon transfer of said developed latent image to said substrate via said transfer station, and (f) recycling means for transferring said removed excess amount of said carrier liquid back to said means for supplying a liquid toner.

2. An apparatus for high speed self-fix electrographic printing comprising:

(a) a ferro-electric recording member, (b) an electrostatic image deposition device operative for forming an electrostatic latent image on said recording member, (c) means for supplying a liquid toner comprising toner particles and a carrier liquid to said latent image to develop said latent image, said means for supplying comprising a donor roller operatively arranged for inking said ferro-electric recording member with said liquid toner, (d) a vacuum extraction device removing an excess amount of said carrier liquid from said developed latent image, (e) a transfer station transferring said developed latent image after removal of excess carrier liquid to a substrate, wherein an amount of said carrier liquid removed from said latent image by said vacuum extraction device allows a self-fix of said developed latent image on said substrate upon transfer of said developed latent image to said substrate via said transfer station, and (f) recycling means for transferring said removed excess amount of said carrier liquid back to said means for supplying a liquid toner.

3. An apparatus as in claim 2, further comprising an intermediate member between said recording member and said transfer station.

4. An apparatus as in claim 3, further comprising a second vacuum extraction device removing excess carrier liquid from said developed latent image on said intermediate member.

5. An apparatus for high speed electrographic printing as in claim 4, further comprising a cleaning unit adapted for cleaning said intermediate member.

6. An apparatus as in claim 4, further comprising a cleaning unit adapted for cleaning said recording member and adapted for applying a layer of said carrier liquid to said intermediate member.

7. An apparatus for high speed electrographic printing as in claim 4, further comprising a wetting unit for applying a layer of said carrier liquid to said intermediate member.

8. An apparatus as in claim 4, wherein said vacuum extraction device and said second vacuum extraction device comprise respective first and second elongate slits extending transverse to a direction of travel of said recording member and said intermediate member, respectively, said first and second slits being spaced from a respective one of said recording member and said intermediate member by a space within a range including 0.05 to 5 mm and each said first and second slits having a width within a range including 0.5 to 5 mm.

9. An apparatus as in claim 4, wherein each said vacuum extraction device and said second vacuum extraction device produces a vacuum pressure within a range including 1 to 80 kPa.

10. An apparatus as in claim 4, comprising a first cleaning unit for cleaning said recording number and a second cleaning unit for cleaning said intermediate member.

11. An apparatus as in claim 2 wherein said vacuum extraction device provides a vacuum pressure within a range including 1 to 80 kPa.

12. An apparatus as in claim 2 wherein said vacuum extraction device includes an elongate slit extending transverse to a direction of travel of said recording member, a slit being spaced from the recording member by from 0.05 to 5 mm and having slit width of from 0.5 to 5 mm.

13. An apparatus as in claim 2, wherein said transfer station comprises a transfer roller.

14. An apparatus as in claim 2, wherein said means for forming said electrostatic latent image on said recording member comprises digital means.

15. An apparatus for high speed electrographic printing as in claim 2, further comprising a cleaning unit adapted for cleaning said recording member.

16. An apparatus as in claim 15, wherein said cleaning unit comprises a driven cleaning roller, means for applying said carrier liquid to the recording member before it reaches the cleaning roller and extraction means to remove excess carrier liquid from the recording member.

17. An apparatus as in claim 2, further comprising a cleaning unit adapted for cleaning said recording member and adapted for applying a layer of said carrier liquid to said recording member.

18. An apparatus for high speed electrographic printing as in claim 2, further comprising a wetting unit adapted for applying a layer of said carrier liquid to said recording member.

19. An apparatus as in claim 2, further comprising a toner separator for separating said recycled toner material and air.

20. An apparatus as in claim 19, wherein said toner separator comprises a housing having an inlet for extracted toner and air, a baffle assembly around said inlet, an air exit and a toner outlet outside the baffle assembly, said air exit being connected to a source of reduced pressure.

21. An apparatus for high speed self-fix electrographic printing including a plurality of printing stages, each printing stage comprising a high speed self-fix printing apparatus, said printing apparatus comprising:

a ferro-electric recording member;

an electrostatic image deposition device forming an electrostatic latent image on said recording member;

means for supplying a liquid toner comprising toner particles and a carrier liquid to said latent image for developing said latent image, said means for supplying comprising a donor roller operatively arranged for inking said ferro-electric recording member with said liquid toner;

a vacuum extraction device removing an excess amount of said carrier liquid from said developed latent image;

a transfer station transferring said developed latent image to said substrate after removal of said excess amount of said carrier liquid, wherein an amount of said carrier liquid removed from said latent image by said vacuum extraction device allows a self-fix of said developed latent image on said substrate upon transfer of said developed latent image to said substrate via said transfer station; and recycling means for transferring said removed excess carrier liquid back to said means for supplying a liquid toner.

* * * * *